US007156269B1

(12) United States Patent
Meyer et al.

(10) Patent No.: US 7,156,269 B1
(45) Date of Patent: Jan. 2, 2007

(54) SAND AND SEED DIVOT REPLACER FOR GOLFERS

(76) Inventors: John W. Meyer, 53 Andy Creek La., Cascade, MT (US) 59421; Doug Jacoby, 118 Andy Creek La., Cascade, MT (US) 59421

( * ) Notice: Subject to any disclaimer, the term of this patent is extended or adjusted under 35 U.S.C. 154(b) by 160 days.

(21) Appl. No.: 10/789,886

(22) Filed: Feb. 27, 2004

Related U.S. Application Data

(63) Continuation-in-part of application No. 09/943,074, filed on Aug. 29, 2001, now abandoned.

(60) Provisional application No. 60/230,393, filed on Sep. 6, 2000.

(51) Int. Cl.
*B65D 5/72* (2006.01)

(52) U.S. Cl. ..... 222/568; 222/105; 222/181.2; 222/465.1; 222/566; 222/575; 224/148.4

(58) Field of Classification Search ..... 222/180, 222/566–568, 196, 196.1, 575, 610, 173, 222/181.2, 475, 465.1, 183, 105; 224/274, 224/401, 148.2, 148.4; 206/217, 477, 564; 248/318, 205.1, 311.2, 310
See application file for complete search history.

(56) References Cited

U.S. PATENT DOCUMENTS

| | | | | |
|---|---|---|---|---|
| 3,058,633 | A * | 10/1962 | Muhlhoff | 222/568 |
| 3,338,482 | A * | 8/1967 | Jordan | 222/479 |
| 3,672,547 | A * | 6/1972 | Kozlowski | 222/567 |
| 4,452,381 | A * | 6/1984 | Freeman | 222/465.1 |
| 5,279,450 | A * | 1/1994 | Witt, Jr | 222/377 |
| 5,772,069 | A * | 6/1998 | Price | 220/737 |
| 6,739,486 | B1 * | 5/2004 | Winkler | 222/608 |
| 2002/0037779 | A1 * | 3/2002 | Meyer et al. | 473/408 |

* cited by examiner

*Primary Examiner*—Frederick C. Nicolas
(74) *Attorney, Agent, or Firm*—Richard C. Conover

(57) ABSTRACT

A sand and seed divot replacer including a pour spout having a female threaded portion integrally formed on the inner surface of the pour spout at an end distal from the pouring end. A bottle is provided having an open top and a closed bottom. The bottle including a male threaded portion located on the exterior of the main body portion adjacent the top for threadably mating with the female threaded portion of the spout. The bottom wall of the bottle including an indented portion. A holder is provided having a main body portion open at the top and closed at the bottom with a bottom wall. The holder is sized for receiving the bottle and spout. The bottom wall of the holder includes an indented portion sized for nesting in the indented portion of the bottle.

2 Claims, 6 Drawing Sheets

SAND AND SEED DIVOT REPLACER FOR GOLFERS

SPECIFICATION

This application is a continuation-in-part of U.S. patent application Ser. No. 09/943,074, filed Aug. 29, 2001, now abandoned which claimed the benefit of provisional application Ser. No. 60/230,393 filed Sep. 6, 2000.

BACKGROUND OF THE INVENTION

The present invention relates to a sand and seed divot replacer for use by golfers.

When golfing, golfers often form divots in the fairways when making golf shots. Many golf courses request golfers to replace the divots with a sand and seed mixture allowing new grass to form.

Known sand and seed divot replacers include a bottle with spout. The bottle is provided with a threadably removable bottom wall for closing the bottom of the bottle. In order to fill these bottles, the bottle and spout are inverted and the threaded bottom wall removed. The seed and sand mixture is then poured into the inverted bottle. With these devices, however, the spout needs to be closed when filling the bottle with the sand and seed mixture. This can be inconvenient and may cause loss of seed and sand mixture during the filling process. Further, the known sand and divot bottle kits include holders for holding the bottle. But with the known holders, the bottle is held loosely in the holder causing the bottle to rattle when a golf cart, to which the holder is mounted, is driven around the golf course.

With the present invention, many of the problems of the known sand bottle kits are resolved. The spout is threadably mounted to the bottle, and when it is desired to fill the bottle, the threaded spout is removed and the bottle simply filled. There is no loss of sand and seed, and there is no need to close the spout when filling the bottle. Further, a holder is provided which seats the bottle in the holder to prevent rattling.

SUMMARY OF INVENTION

The present invention includes a spout having an elongate spout body with a bent pour spout integrally formed at one end thereof. At the other end of the hollow spout body, a female threaded portion is integrally formed on the inner surface of the spout body at the end distal from the bent pour spout. A bottle is provided including a cylindrically-shaped main body portion. This bottle is open at the top and closed at the bottom with a bottom wall. The bottle includes a male threaded portion located on the exterior of the main body portion adjacent the top for threadably mating with the female threaded portion of the spout. The bottom wall further includes an indented hemispherical portion centrally located. A holder is provided having a main body portion open at the top and closed at the bottom with a bottom wall. The holder is sized for receiving the bottle and spout. The bottom wall of the holder means includes a plurality of cut-outs spaced around the periphery of the bottom wall, and further includes an indented hemispherical portion sized for nesting in the indented hemispherical portion of the bottle. Further, the holder includes a mounting bracket integrally formed to the exterior surface of the main body portion of the holder for mounting the holder to a support structure, such as a golf cart.

DESCRIPTION OF THE DRAWINGS

In order that the invention may be clearly understood and readily carried into effect, a preferred embodiment of the invention will now be described, by way of example only, with reference to the accompanying drawings wherein.

DESCRIPTION OF A PREFERRED EMBODIMENT

Figure 1:
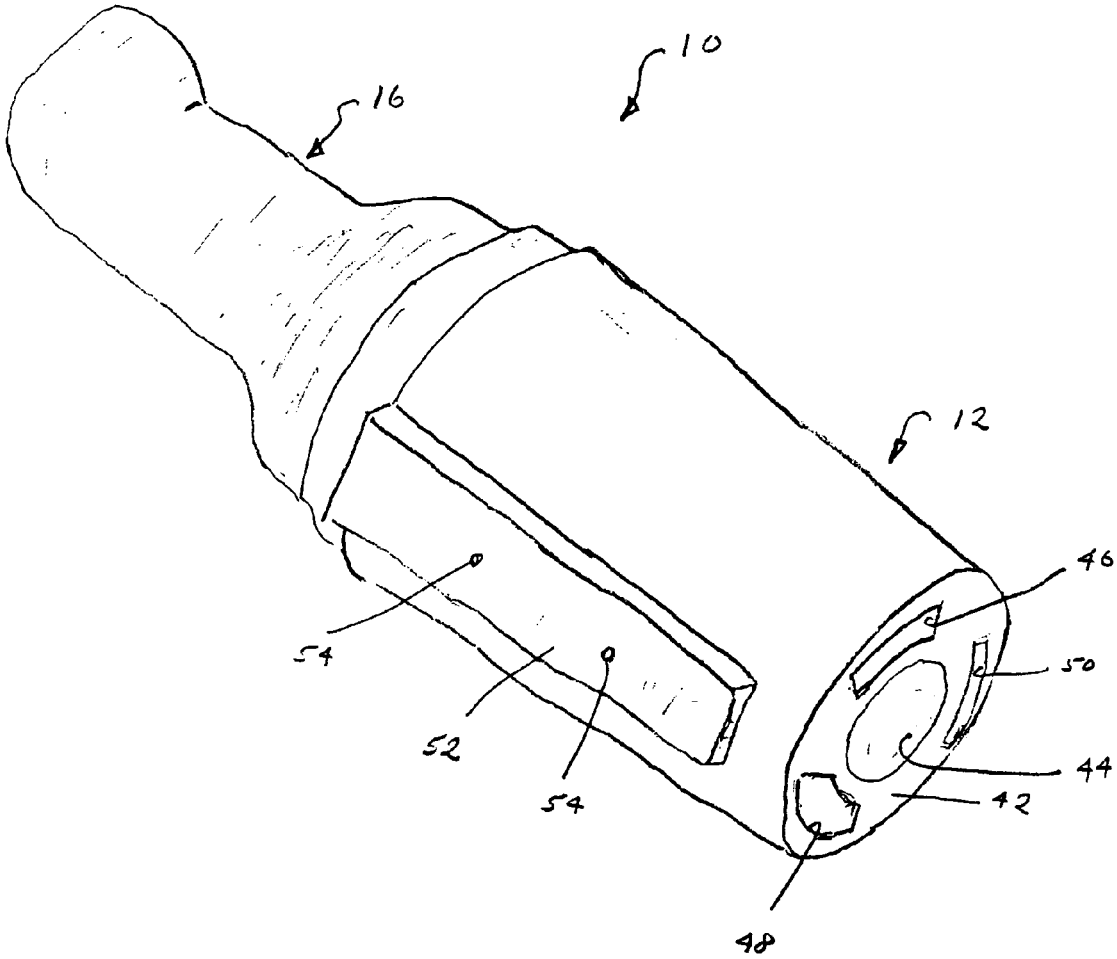
FIG. 1 is a perspective view of the present invention completely assembled.
Figure 2:
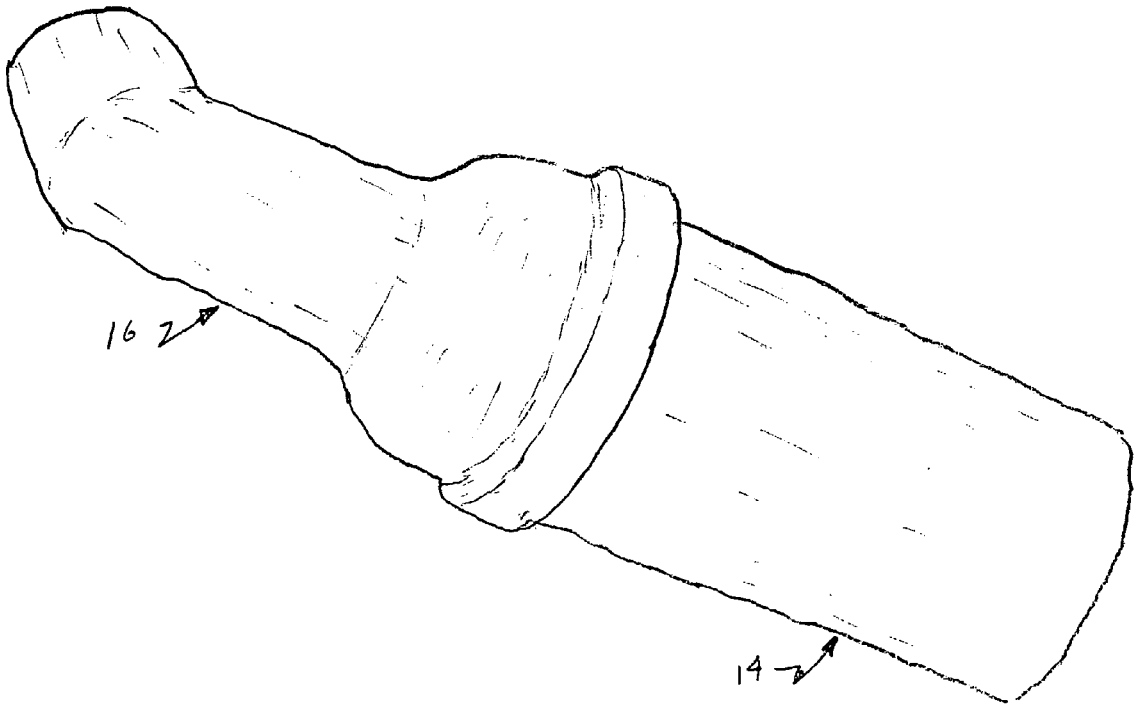
FIG. 2 is a perspective view of a bottle and spout assembled in accordance with the present invention.

A sand and seed divot replacer 10 is shown in FIG. 1. The sand and seed divot replacer 10 includes a bottle holder 12 for holding a bottle 14 having a spout 16. The bottle 14 with spout 16 is shown in FIG. 2 being separated from holder 12.

Figure 3:
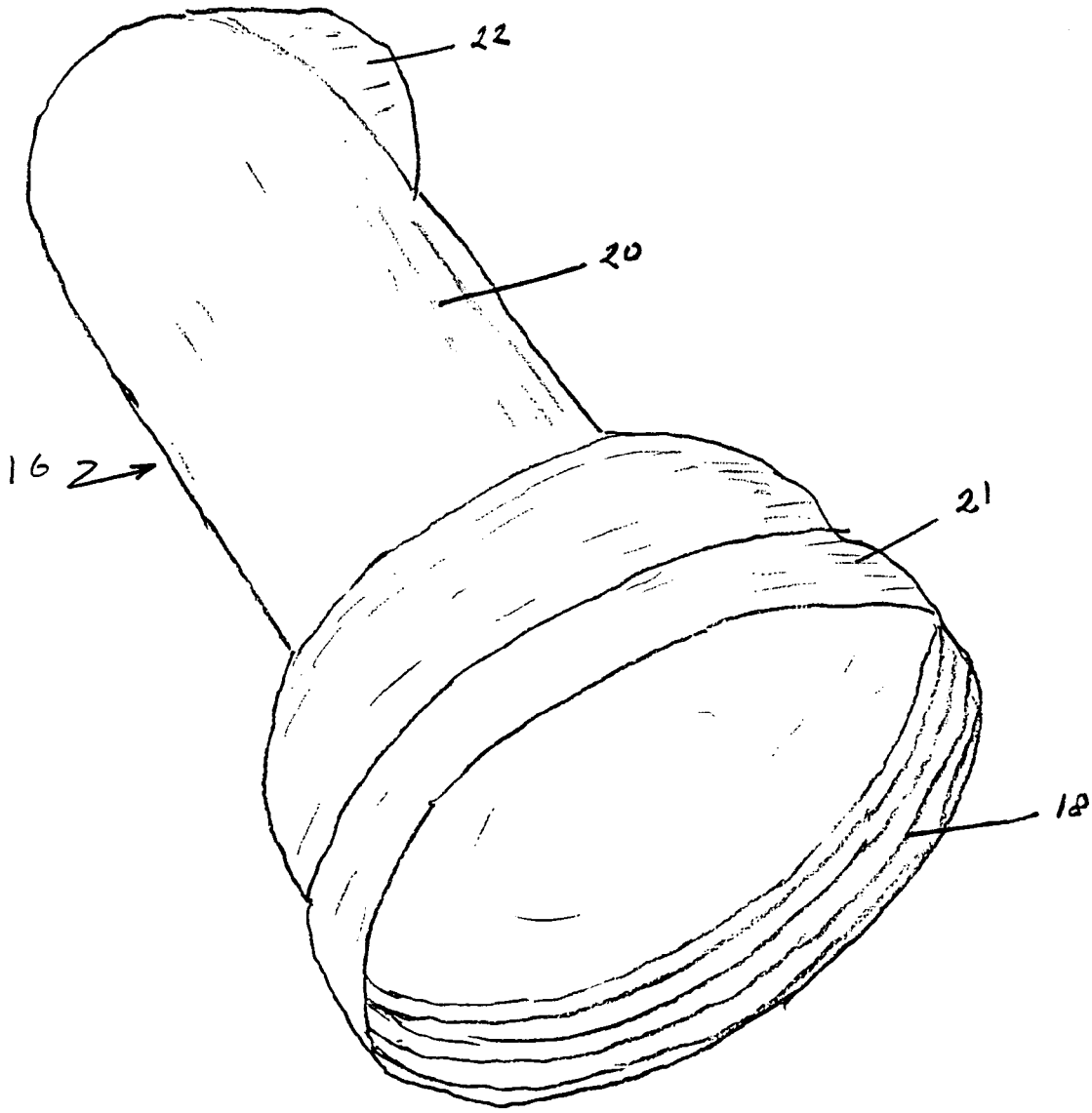
FIG. 3 is a perspective view of the spout used with the present invention.

As shown in FIG. 3, the spout 16 includes a main spout portion 20 having a longitudinal axis. At one end of the main spout portion 20, an enlarged portion 21 is integrally formed thereto. Female threads 18 are integrally formed on an interior surface of the enlarged portion 21. At an end of the main spout portion 20, distal from the female threads 18, a bent pour spout 22 is integrally formed with the main spout portion 20. In a preferred embodiment, the bent pour spout has a length less than one-third of the length of the main spout portion 20. The bent pour spout extends in a direction generally perpendicular to the longitudinal axis of the main spout portion 20. With the bent pour spout having this configuration, a golfer can easily direct the spout end over the divot to be repaired. The spout 16 is open through the enlarged end 21, the main spout portion 20 and the spout end 22.

Figure 4:
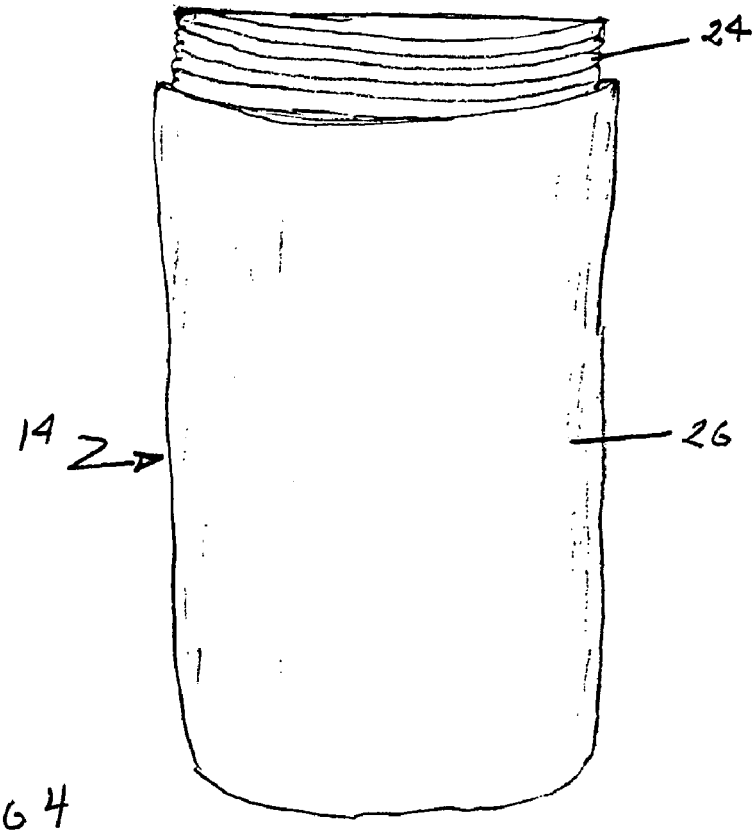
FIG. 4 is a front elevational view of the bottle used with the present invention.
Figure 5:
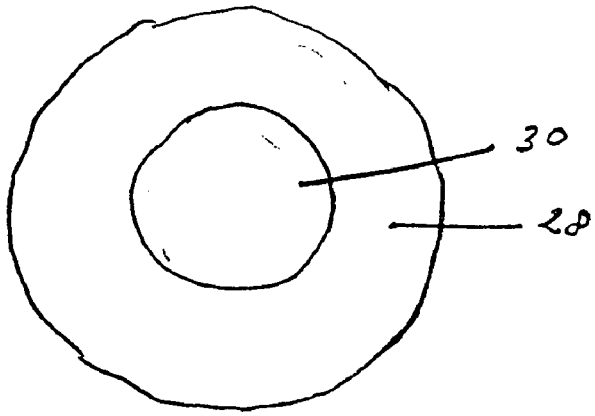
FIG. 5 is a bottom view of the bottle shown in FIG. 4.

The bottle 14 is shown in FIGS. 4 and 5, and includes a male threaded top end 24 to be received by threaded lid 18 of spout 16. Bottle 14 further includes a cylindrically shaped main body portion 26 and a closed end wall 28, as shown in FIG. 5. The end wall 28 includes a concave hemispherical indented portion 30 extending toward the interior of bottle 14.

Figure 6:
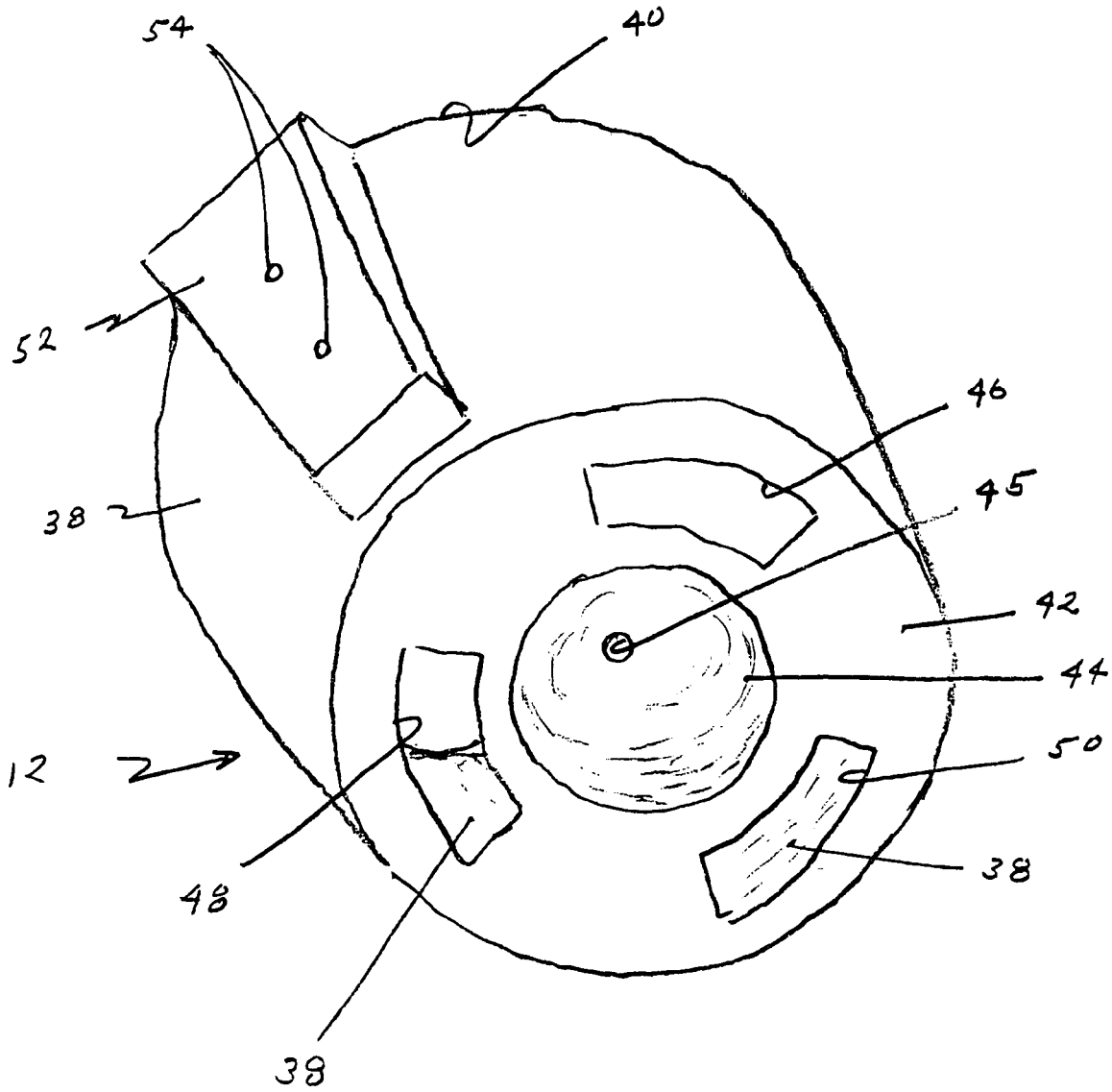
FIG. 6 is a perspective view of a bottle holder according to the present invention.

The bottle holder 12 is shown in FIG. 6. The holder 12 includes a cylindrical wall section 38 having an open top 40 and a bottom wall 42. The bottom wall includes a hemispherical indented portion 44 extending toward the interior of holder 12, which portion is sized to nest within the hemispherical indented portion 30 of bottle 14 when bottle 14 is placed in holder 12. The hemispherical shape of the indented portion 44 and indented portion 20 aid in positioning the bottle 14 in bottle holder 12. The bottle will automatically index with the holder, thus the bottle will not be canted with respect to the holder when placed in the holder. An axial hole 45 is provided in indented portion 44.

The bottom wall 42 further includes three cutouts, 46, 48 and 50, as shown in FIG. 6.

The holder 12 further includes a mounting bracket 52 having screw holes 54 which, if desired, can be used to mount the holder to an appropriate surface of a golf cart, for example.

Figure 7:
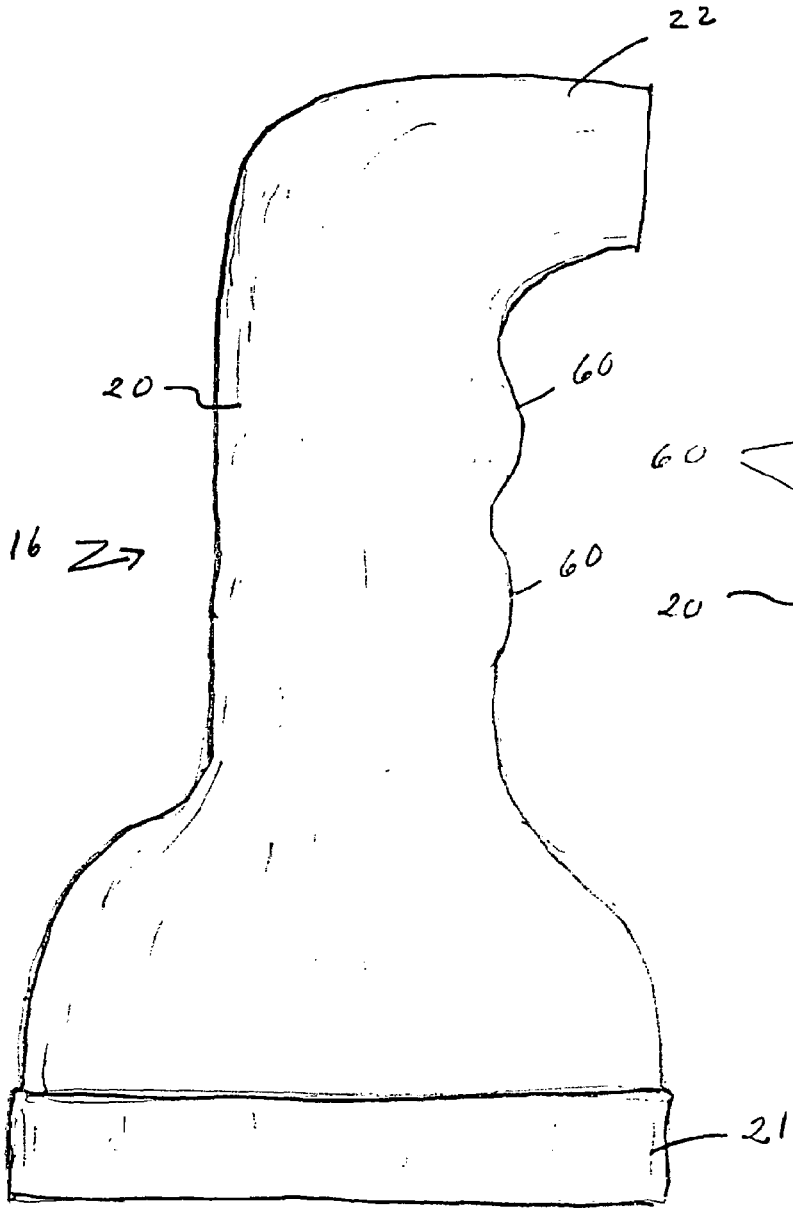
FIG. 7 is an elevational view of a spout according to a second embodiment of the present invention.
Figure 7A:
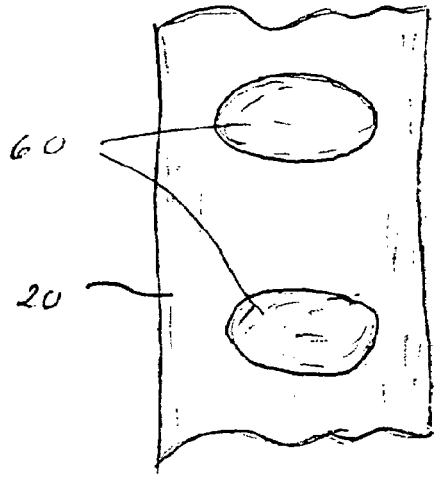
FIG. 7A is a right side of the spout shown in FIG. 7 with parts broken away.

A second embodiment of a sour spout 16 is shown in FIGS. 7 and 7A. This sour spout 16 further includes a pair of finger grips 60 to enable a user to more securely grasp the spout 16 when removing the bottle 14 from the holder 12 and repairing a divot.

In operation, the bottle 14 is filled with seed and sand by unscrewing spout 16 from bottle 14, and filling bottle 14 with sand and seed. The spout 16 is then threaded onto bottle 14. The bottle 14 with spout 16 is then placed in bottle holder 12 for storage. With the indented portion 44 of holder 12 nesting within the indented portion 30 of bottle 14, the bottle 14 is prevented from rattling when the golf cart is driven around the golf course. When it is desired to use bottle 14 to fill a divot, the bottle 14 with spout 16 is removed from holder 12 and sand and seed poured through spout end 22 into the divot to be repaired.

While the fundamental novel features of the invention have been shown and described, it should be understood that various substitutions, modifications, and variations may be made by those skilled in the art, without departing from the spirit or scope of the invention. Accordingly, all such modifications or variations are included in the scope of the invention as defined by the following claims:

We claim:

1. A sand and seed divot replacer comprising:

a spout including an elongate, hollow main body portion having a hollow bent pour spout integrally formed at a first end thereof and a female threaded portion integrally formed on the interior surface of the main body portion adjacent a second end thereof;

a bottle including a main body portion open at the top and closed at the bottom with a bottom wall;

the bottle further including a male threaded portion on the exterior surface of the main body portion adjacent the open top for threadably mating with the female threaded portion of the spout; and a hollow holder means having a main body portion open at the top and closed at the bottom with a bottom wall for holding the bottle and spout;

the holder means sized to receive the bottle within the interior thereof;

the holder means further including a mounting bracket means integrally formed on the exterior surface of the main body portion of the holder means for mounting the holder to a support structure;

the bottle having a cylindrical shape with a longitudinal axis, and wherein the bottom wall of the bottle includes a concave indented portion extending inwardly and wherein the bottom wall of the holder includes a plurality of cut-outs spaced around the periphery of the bottom wall and further includes a convex indented portion extending inwardly and positioned and sized for nesting in the indented portion of the bottle when the bottle is positioned within the holder;

the indented portion of the bottle and the indented portion of the holder having a corresponding hemispherical shape;

the main body portion of the spout extending in a direction generally coaxial with the longitudinal axis of the bottle;

the bent pour spout extending in a direction generally perpendicular to the longitudinal axis of the bottle and having a length less than one-third the length of the main body portion; and a pair of convex shaped finger grips provided on the main body portion directly beneath the bent pour spout.

2. The said divot replacer of claim 1 wherein the main body portion of the spout includes an enlarged portion at the second end thereof and wherein the female threaded portion is positioned within the enlarged portion.

* * * * *